US005941477A

United States Patent [19]

Basili et al.

[11] Patent Number: 5,941,477

[45] **Date of Patent: *Aug. 24, 1999**

[54] VIRTUALLY FULLY ENGAGABLE STACKING REEL COMPONENT

[75] Inventors: Robert A. Basili, Waldwick; Naiyi Wang, Union City; Benjamin R. Zuk, Park Ridge, all of N.J.

[73] Assignee: Plastic Reel Corporation of America, Carlstadt, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,035

[22] Filed: Feb. 21, 1997

[51] Int. Cl.[6] ..... B65H 75/14

[52] U.S. Cl. ..... 242/608.6; 242/609.1; 242/613.1

[58] Field of Search ..... 242/608.6, 608.5, 242/609.1, 613.1; 206/394

[56] References Cited

U.S. PATENT DOCUMENTS

| | | | |
|---|---|---|---|
| 1,050,371 | 1/1913 | Merkel . | |
| 2,605,057 | 7/1952 | Faulkner et al. . | |
| 3,176,932 | 4/1965 | Kovaleski | 242/609.1 X |
| 3,642,223 | 2/1972 | Feichtinger . | |
| 4,081,151 | 3/1978 | Ender et al. | 206/394 X |
| 4,201,353 | 5/1980 | Schor | 206/394 X |
| 4,234,137 | 11/1980 | Watanabe et al. . | |
| 4,340,188 | 7/1982 | Derendorf et al. | 206/394 X |
| 4,341,357 | 7/1982 | De Filippo | 206/394 X |
| 4,726,534 | 2/1988 | Chenoweth . | |
| 5,524,850 | 6/1996 | Liao | 242/608.6 |
| 5,676,332 | 10/1997 | Kraus et al. | 242/608.6 |

FOREIGN PATENT DOCUMENTS

| | | | |
|---|---|---|---|
| 22 52 024 | 5/1974 | Germany . | |
| 2904721 | 8/1980 | Germany | 242/609.1 |
| 4202218 | 7/1993 | Germany | 242/609.1 |

*Primary Examiner*—Daniel P. Stodola
*Assistant Examiner*—Gregory J. Strimbu
*Attorney, Agent, or Firm*—Anthony J. Casella; Gerald E. Hespos; Ludomir A. Budzyn

[57] ABSTRACT

A stacking reel component having cooperative locking members which when engaged with the cooperative locking members of a second reel component exert and receive axial forces in forming a reel. The reel component is formed to allow compact stacking with other reel components. The hub of the reel component is formed with a plurality of ribs, each pair of ribs defining a through slot therebetween. The hub is also provided with two pairs of apertures. When stacked, the ribs of each reel component registers with the through slots of the adjacent reel components, and the projecting cooperative locking members of each of the reel components is encompassed by a pair of accommodation apertures formed in an adjacent reel component.

26 Claims, 5 Drawing Sheets

VIRTUALLY FULLY ENGAGABLE STACKING REEL COMPONENT

BACKGROUND OF THE INVENTION

1. Field of the Invention.

The present invention relates to a film and sheet material storage device and particularly to an improved reel assembly formed by reel components held in engagement by axial forces where the reel components can be stacked in a compact manner before assembly and after disassembly.

2. Description of the Prior Art.

Reel designs were at one time used primarily by the motion picture and television industries for storage of film. These designs did not change over time, basically adhering to a preassembled two-walled, central hub design. However, the recent explosion of microcomputers and electronics has created an additional use for reel designs. Today, electronic components and computer chips, which are relatively small in size, are stored on a compartmentalized carrier tape which is taken up onto a reel. The carrier tape may also be formed by two separate gummed layers, joined with the gummed faces being in face-to-face engagement wherein electronic components may be stored therebetween. The phrase "carrier tape", as used herein, is intended to cover all forms of film, tape, ribbon and substrate which are suitable for take up on a reel.

As a result, a new reel market has been created with storage concerns never raised by the film industry. The tremendous amount of electronic gadgetry which is being sold, requires an equally tremendous amount of electronic components, which, in turn, translates to a great number of reels. Due to the design of a reel, a large amount of volume is required to store the reel before and after use. In response to this problem, manufacturers began selling stackable reel components which, with minor assembly, could form a reel. The prior art reel components are formed with a central hub and a surrounding side wall extending circumferentially therefrom to a predetermined diameter. To form a reel, two of the prior art reel components are typically glued, ultrasonically welded or joined through the engagement of cooperating retaining means formed on the surface of the hub, such as that found in U.S. Pat. No. 4,726,534 (hereinafter "'534 patent") to Dean B. Chenoweth.

When stacked, however, spaces are formed between neighboring reel components. Prior art hub designs did not permit full face-to-face engagement between neighboring, stacked reel components, since the hubs were not formed to define an inner surface able to accommodate the diameter of the outer surface of the hub of a neighboring stacked reel component. Thus, prior art reel components allowed nesting only to the extent the inner surface of the hub was equal to or larger than the outer dimension of the hub. As a result of the spaces being formed between stacked reel components, tremendous volume is required to store a relatively few number of reel components. Shipping costs and waste carting fees are relatively high for objects having a low weight and encompassing a high volume. Thus, there is a need for reel components which can be stacked in a compact manner requiring minimal volume.

The space formed between the prior art reel components, however, is necessary for some prior art designs. For example, the cooperative retaining means of the '534 patent project from the hub and would prevent perfect nesting between reel components. Thus, the space between the reel components forms a housing for the retaining means. A reduction in the height of the space would require retaining means which would not prevent contact between the hub of one reel component and the hub of a second reel component. Therefore, there is a need for a cooperative retaining arrangement which would not prevent the compact stacking of reel components.

Also, reel components which can be formed through the engagement of cooperating retaining means are more desirable than those requiring gluing or ultrasonic welding. Labor, time and assembly inaccuracies are reduced where a reel assembly can be formed through the engagement of cooperating retaining means. Since the take up and winding of carrier tape exerts rotational forces on a reel assembly, the rotational orientation of engaged retaining means, such as that found in the '534 patent, results in increased loading and a greater likelihood of failure in the retaining means members. There is a need for a reel assembly which is held in engagement by cooperating retaining means oriented to exert and receive axial forces.

Reel components are preferably molded from recyclable plastic. Unfortunately, assembled reels require even more volume for shipping than the previously discussed prior art stacked reel components. Unlike the individual reel components, assembled reels are not capable of nesting at all. Accordingly, costs for storage and removal to recycling are relatively high considering the necessary volume. Indeed, there is a need for a reel assembly which can be readily disassembled, allowing individual reel components to be stacked.

In summary, there is a need for a reel component formed to require minimal space when stacked and having cooperative retaining means which are aligned to transmit and receive axial forces, do not prevent compact stacking and allow for disengagement.

SUMMARY OF THE INVENTION

It is an object of the present invention to provide reel components capable of compact stacking.

Another object of this invention is to provide a reel component having a retaining means arrangement which does not prevent compact stacking.

Also, an object of this invention is to provide a retaining means arrangement formed and oriented to exert and receive axial forces when in engagement.

Yet, another object of the invention is to provide a retaining means arrangement capable of disengagement.

The above mentioned objects of the present invention are achieved by a reel component comprising a hub and a planar side wall extending radially therefrom to a predetermined diameter.

The hub comprises a plurality of evenly spaced ribs angled slightly to form a tapered ring, which support an annular attaching wall. Each pair of spaced ribs forms an engaging through slot therebetween, which has a width equal to or greater than the width of each of the ribs. When stacking the new and improved reel components of the subject invention, the reel components are aligned so that the ribs of an upper stacked reel component will engage the engaging through slots of a lower stacked reel component. In turn, a third reel component is stacked in a similar fashion, resulting with the first and third stacked reel components having identical rib and engaging slot orientations. The ribs of the third reel component will be in contact with the ribs of the first reel component, thereby bypassing the hub of the second reel component. Unlike the prior art, the new and improved reel component of the subject invention is not hindered by any contact between two neighboring hubs. The ribs and engaging slots of the new and improved reel component of the subject invention allow reel components to be stacked with the inside surface of one reel component in virtual contact with the attaching wall of a second reel component. Thus, one feature of this invention allows reel components to be stacked in a compact arrangement.

Another feature of the new and improved reel component of the subject invention is the inclusion of two pairs of accommodation apertures formed in the attaching wall of the hub. The accommodation apertures are arranged and dimensioned to encompass any members which protrude from a lower stacked reel component. With the accommodation apertures, any protrusions formed on a reel component, such as cooperating retaining means members, will be enveloped by an upper stacked reel component, and the protrusions will not prevent the compact stacking of the reel components. As used herein, "compact stacking" denotes a stacked relationship where reel components nest with adjacent stacked reel components with adjacent reel components being virtually in full face-to-face engagement.

The new and improved reel component of the subject invention also has cooperative retaining means formed and oriented to transmit and receive axial forces. The cooperative retaining means are disposed along parallel longitudinal axes, such that when two reel components have attaching walls in engagement and are pulled in opposite directions parallel to the longitudinal axes, a reel assembly will be formed.

Yet another feature of the new and improved reel component of the subject invention allows the disassembly of an assembled reel. The cooperative retaining means comprises a pair of locking arms and a pair of receiving arms formed on the attaching wall of the subject reel component. A detent is disposed on the end of each arm having an angled engaging surface. When assembled, the detent engaging surface of each locking arm is in contact with the detent engaging surface of a receiving arm. The engaging surfaces are formed to define an acute angle. When longitudinal forces are applied in directions opposite that which is required for assembly, the angled detent surface of the locking arm will slide down and disengage from the engaging surface of the corresponding receiving arm detent. As a result, an assembled reel may be disassembled into reel components.

These and other features of the invention will be better understood through a study of the following detailed description of the invention and the accompanying drawings.

DETAILED DESCRIPTION OF THE PREFERRED EMBODIMENTS

Figure 1:
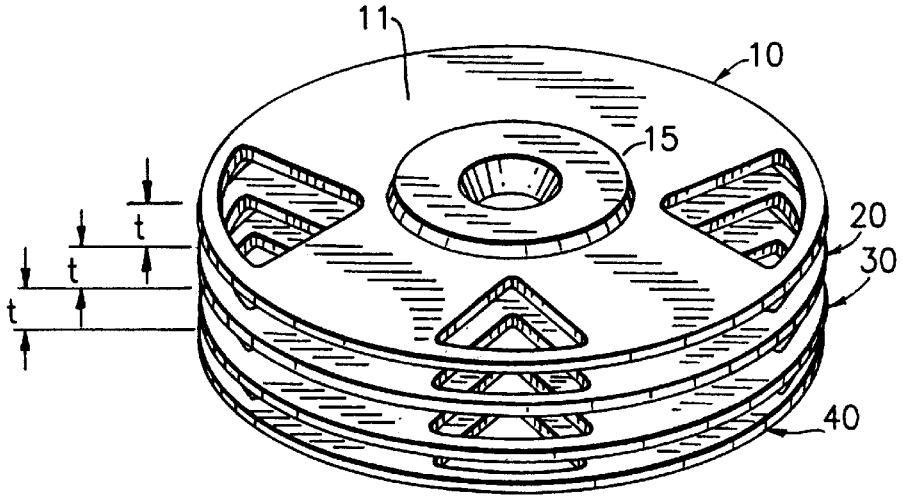
FIG. 1 PRIOR ART
FIG. 1 is a plan view of prior art reel components in stacked engagement.
Figure 2:
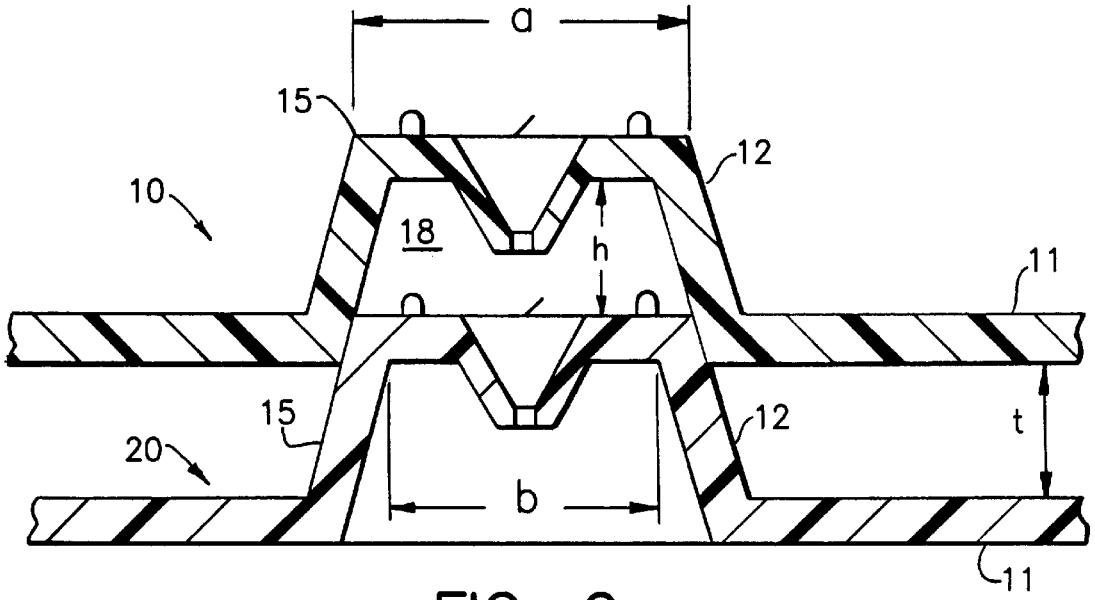
FIG. 2 PRIOR ART
FIG. 2 is a cross-sectional view of prior art reel assemblies in stacked engagement.

For a better understanding of the invention, a more thorough explanation of the deficiencies of the prior art is required. FIG. 1 shows a stack of prior art reel components 10, 20, 30, 40, each formed with a side wall 11 and a hub 15. As can be readily seen in FIG. 1, a distance "t" separates the side wall 11 of each reel component 10, 20, 30, 40. Although prior art reel components could be stacked, the structure of the hub would not allow for compact stacking and a minimization of distance "t". FIG. 2 shows the cross-section of two identical prior art reel sections 10, 20 in stacked engagement. The reel components 10, 20 both have a hub diameter "a" and internal diameter "b", which is less than diameter "a". As a result, when stacked, the solid tapered support walls 12 of the hubs 15 come into contact, and the neighboring hubs are prevented from coming into full face-to-face contact. Rather the reel component 10 will slide onto the reel component 20 to a point where the hub of reel component 10 defines an inner cross-section having a dimension equal to diameter "a". A space 18 is formed between the two reel components 10, 20 having a height "h". The failure to close the space between the two reel components 10, 20 and reduce the dimension "h" translates to the distance "t" being formed between the side walls.

Figure 3:
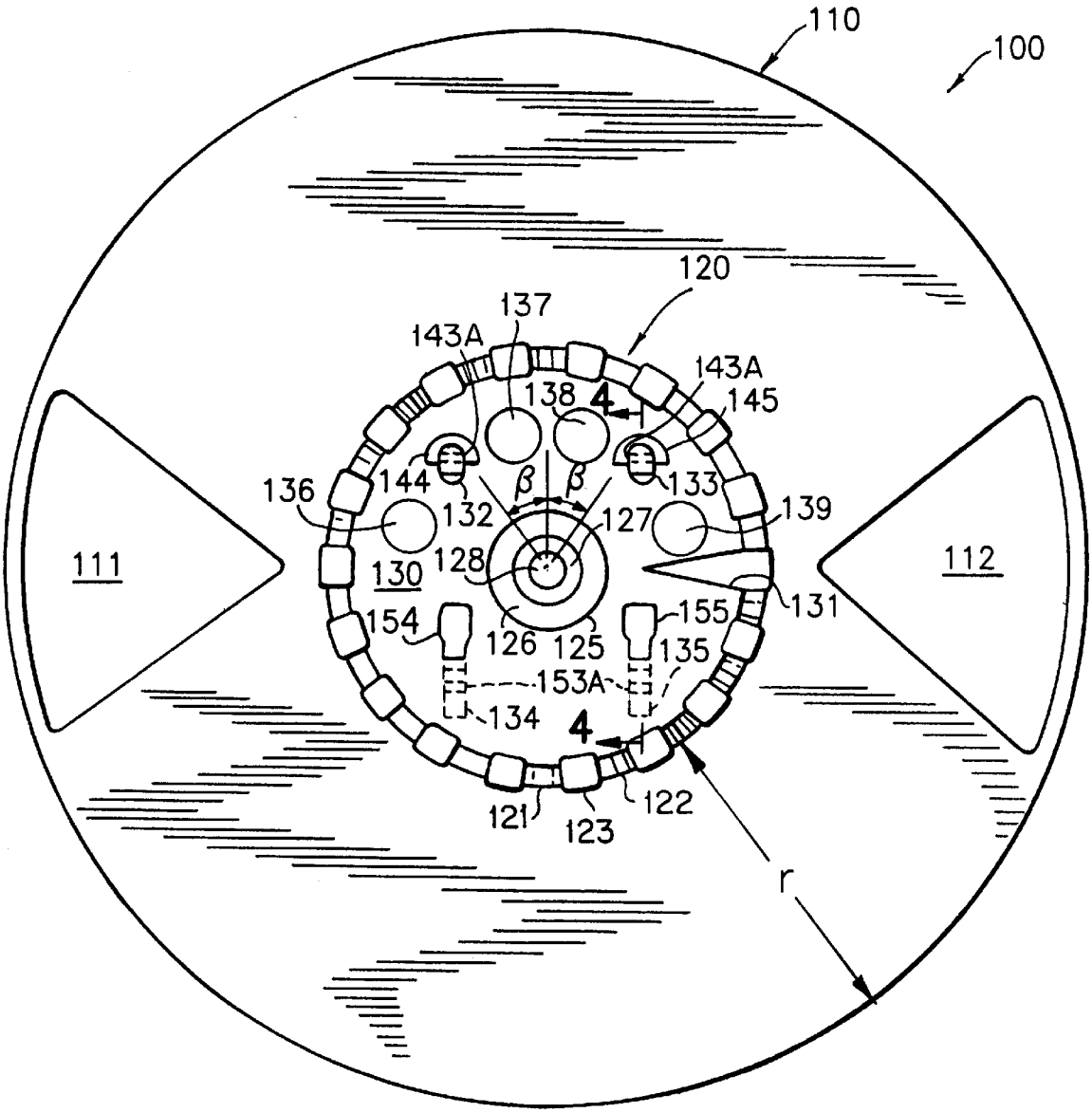
FIG. 3 is a top view of the new and improved reel component of the subject invention.

Referring to FIG. 3, the new and improved reel component of the subject invention is designated by the numeral 100. The reel component 100 comprises a side wall 110 and a hub 120. As FIG. 3 shows, the side wall 110 and the hub 120 are formed as a single piece with the side wall 110 extending radially from the hub 120.

The side wall 110 is formed as an annular planar member having a width equal to the dimension designated as "r". The width "r" can be adjusted to increase or decrease the storage capacity of the reel component 100, where storage capacity increases as a function of a greater wall width "r". Two visual inspection apertures 111, 112 are formed in the side wall 110. The visual inspection apertures 111, 112 allow an operator to visually inspect the amount of carrier tape taken up onto the reel during a storage procedure.

The hub 120 comprises a plurality of ribs 121, 122, a boss 125 and an attaching wall 130. Each of the ribs 121, 122 is identically dimensioned and circumferentially, angularly disposed at equal intervals to form a tapered ring. Between the ribs 121, 122, engaging through slots 123 are formed which have a width equal to or greater than that of the ribs 121, 122. The length of the ribs can be varied to allow for various film and sheet material widths. An increase in the length of the ribs 121, 122 results in a proportional increase in film and sheet material width capacity. The length of the ribs 121, 122 can be selected to create a line of reels for accommodating various carrier tape widths. For example, reel components 100 may be respectively formed with the ribs 121, 122 maintaining the attaching wall 130 at distances of 12 mm, 16 mm and 28 mm, respectively, from the side wall 110. In assembling the reel, as described below, two "12 mm" reel components may be used to form a reel which may accommodate a 24 mm wide carrier tape. Additionally, different sized reel components may be used to assemble the reel. For example, a "16 mm" reel component may be joined with a "28 mm" reel component to form a reel which may accommodate a 44 mm wide carrier tape.

The attaching wall 130 is supported by the ring formed by the ribs 121, 122. A frustoconical boss 125 projects from the center of the attaching wall 130 having a tapered portion 126 and a frustum 127 with a drive shaft aperture 128 formed therein. The drive shaft aperture 128 is dimensioned to accommodate a mechanical drive shaft and may be formed with a notched circumference, the notches being fashioned to engage any keys that may be on the mechanical drive shaft.

Figure 9:
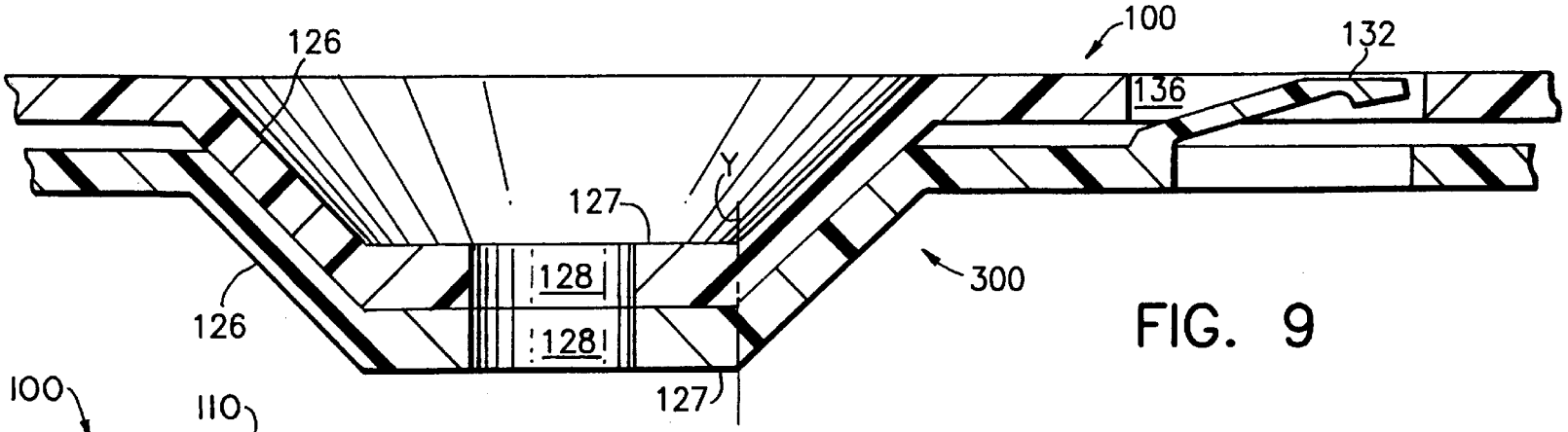
FIG. 9 is a cut-away view of two new and improved reel components of the subject invention in stacked engagement taken along a line along the longitudinal axis of a locking arm and passing through the center of the reel components.

Referring to FIG. 9, the minimum thickness of the frustum 127 is determined by a two-part analysis which evaluates the height of the locking arms 132, 133, the outer diameter of the frustum 127 and the thickness of the attaching wall 130. First, as shown by reference line "Y" in FIG. 9, the frustum 127 must have a thickness which defines an inner diameter within the tapered portion 126 which is at least equal to the outer diameter of the frustum 127. Although not shown, the frustum 127 may have a thickness which defines an inner diameter within the tapered portion 126 which is greater than the outer diameter of the frustum 127. Second, if the locking arms 132, 133 each have a height greater than the thickness of the attaching wall 130, then the frustum 127 must be formed with a thickness which is at least equal to the difference of the height of one of the locking arms 132, 133 and the attaching wall's 130 thickness. If the locking arms 132, 133 do not have a height greater than the thickness of the attaching wall 130, the thickness of the frustum 127 is determined by the first part of this analysis. If the locking arms 132, 133 do have a height greater than the thickness of the attaching wall 130, the frustum 127 must be formed with a thickness which is at least the greater of the two thicknesses determined respectively by the two parts of the analysis.

As shown in FIG. 3, V-shaped notch 131 is cut into the attaching wall 130, extending from the perimeter towards the center of the hub 120. The notch 131 is used to secure the end of the carrier tape during take-up. The attaching wall 130 is formed to define a pair of elongated locking arms 132, 133, a pair of elongated receiving arms 134, 135 and two pairs of accommodation apertures 136, 138, 137, 139. The locking arms 132, 133 are both located on one side of the V-shaped notch 131. Each of the locking arms 132, 133 is a projecting member having an angled portion 140 extending from the attaching wall 130, an elongated flat portion 141 depending therefrom and a detent 142 protruding towards the attaching wall 130 from the flat portion 141. In the preferred embodiment, the locking arms 132, 133 are both formed with the same height which is slightly greater than the thickness of the attaching wall 130.

The detent 142 forms an angled engaging surface 143 defining an acute angle $\alpha$. The engaging surface 143 is formed to define $\alpha$ in the range of 10–25 degrees, preferably measuring 15 degrees. The engaging surface 143 forms two side edges, one edge 143A being closer to the center of the reel component 100. Semi-circles 144, 145 are formed in the attaching wall 130 and extend from the base of each of the locking arms 132, 133 to a radius greater than the length of the locking arms 132, 133. During molding, a pin or molding device may be placed into the semi-circles 144, 145 to form the locking arms 132, 133.

Figure 4:
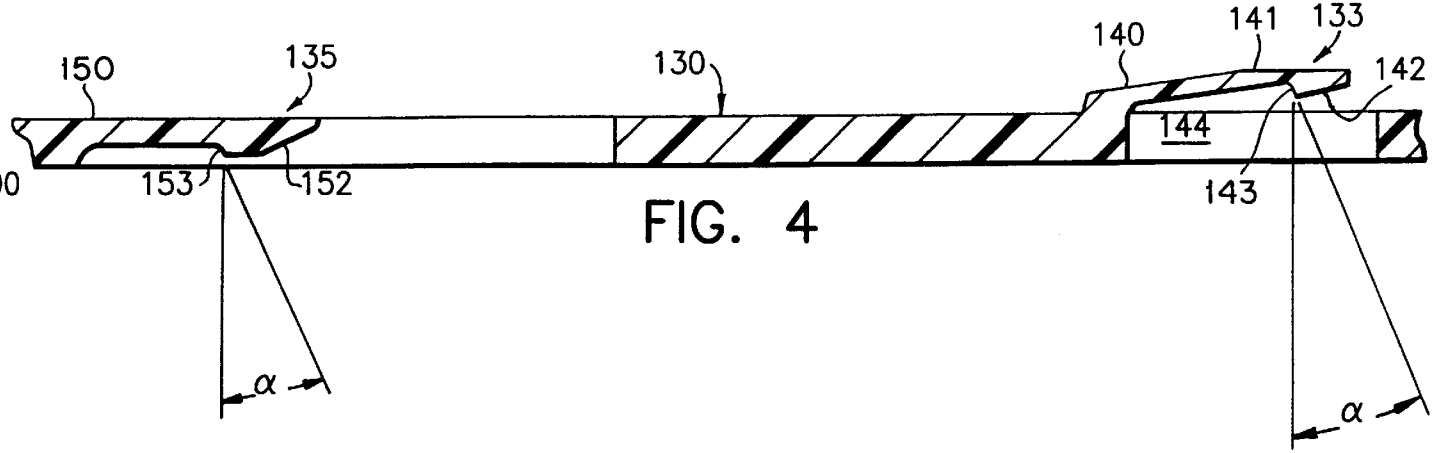
FIG. 4 is a cross-sectional view of the attaching surface taken along line 4—4 in FIG. 3.

Referring to FIG. 4, each of the receiving arms 134, 135 is formed not to extend above the attaching wall 130. Each of the receiving arms 134, 135 comprises an elongated straight portion 150 extending from the attaching wall 130 and a detent 152 depending therefrom. The receiving arm detent 152 has an engaging surface 153 dimensioned similarly to the locking arm detent engaging surface 143 and formed to also define an angle of $\alpha$ in the range of 10–25 degrees, preferably measuring 15 degrees. Although $\alpha$ may be selected from a range of angles, the engaging surfaces 143, 153 must be formed with the same selected angle. The engaging surface 153 also forms two side edges, with one edge 153A being the closer to the center of the reel component 100. A receiving aperture 154, 155 longitudinally extends from the end of each of the straight portions 150 with each dimensioned to allow the passage of the locking arm 132, 133 therethrough.

The receiving arms 134, 135 are disposed on the opposite side of the V-shaped notch 131 from the locking arms 132, 133 along the longitudinal axes of the locking arms 132, 133. The locking arms 132, 133 and the receiving arms 134, 135 are arranged in a rectangular fashion with each arm defining a corner and being equidistant from the center of the reel component 100. As FIG. 3 depicts, the receiving arms 134, 135 and the locking arms 132, 133 are placed so that the center of the inside edges 143A, 153A of the locking detents of diagonally opposed arms form an angle $\beta$.

The accommodation apertures 136, 137, 138, 139 are all arranged on one side of the V-shaped notch 131 with two apertures 137, 138 being disposed between the locking arms 132, 133 and two apertures 136, 139 being outside the locking arms 132, 133. Each of the accommodation apertures 136, 137, 138, 139 are formed to define a diameter greater than the overall length of each of the locking arms 132, 133. The accommodation apertures 136, 137, 138, 139 form two pairs, 136, 138; 137, 139 with the distance between one pair of accommodation apertures 136, 138 being the same as the distance between the locking arms 132, 133 and the same as the distance between the second pair of accommodation apertures 137, 139.

Figure 6:
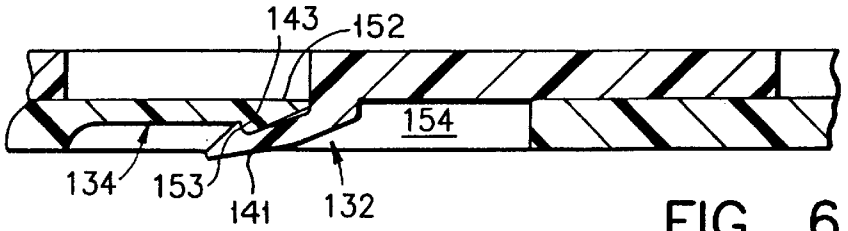
FIG. 6 is a cut-away view of the locking arm and receiving arm in engagement.
Figure 5:
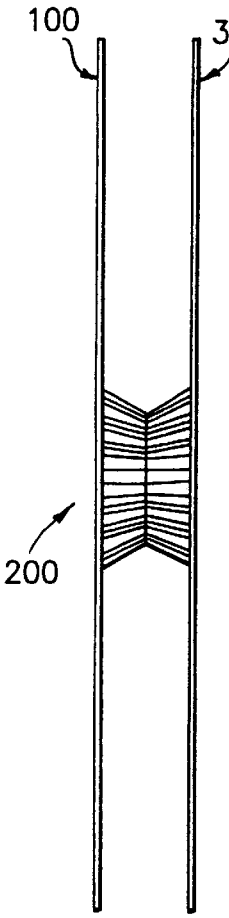
FIG. 5 is a plan view of a reel assembled from two new and improved reel components of the subject invention.

FIG. 5 shows a reel assembly 200 formed from two reel components 100, 300. To form the reel assembly 200, the attaching walls of the reel components 100, 300 need to be placed in face-to-face engagement so that the locking arms 132, 133 of each of the reel components 100, 300 pass through the receiving apertures 154, 155 of the opposite reel component. The reel components 100, 300 can only be assembled with one orientation of the locking arms 132, 133 and the receiving arms 134, 135, thus ensuring features of the two reel components 100, 300, such as the V-shaped notch 131 of each of the reel components 100, 300, are in proper alignment between the reel components 100, 300. By pulling the reel components in opposite longitudinal directions along the axes of the locking arms 132, 133, the detent engaging surfaces 143, 153 will come into engagement. As shown by example in FIG. 6, with the reel components assembled, the engaging surfaces 143, 153 will be in face-to-face contact, forming an angle of contact $\alpha$ to securely maintain the reel components assembled. To disengage the reel components 100, 300, forces can be applied in directions opposite that which is required for assembly to separate the locking arms 132, 133 and the receiving arms 134, 135. Referring to FIG. 6 by example, as force is applied, the engaging surface 143 of the locking arm will slide down the engaging surface 153 with the locking arm 132 eventually disengaging the receiving arm 134.

Figure 7:
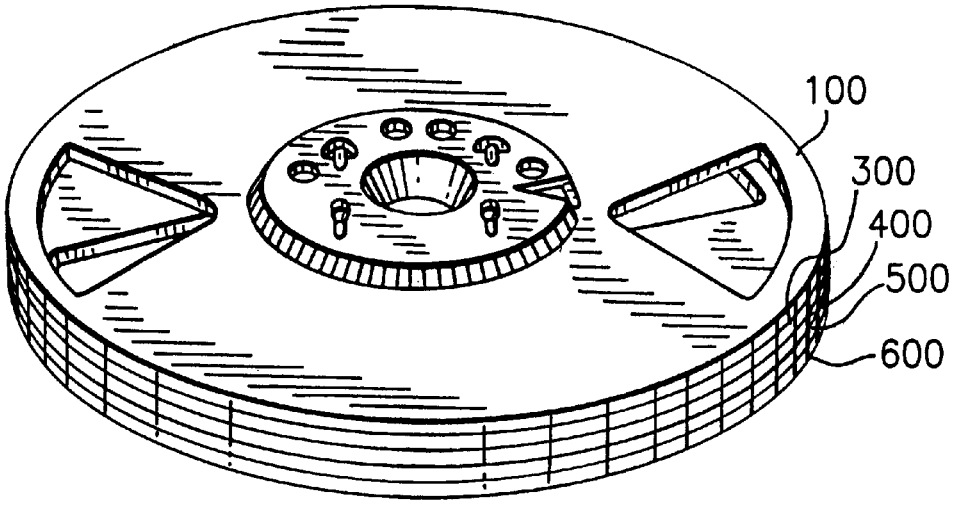
FIG. 7 is a plan view of the new and improved reel components of the subject invention in virtual stacked engagement.

FIG. 7 shows a set of reel components 100, 300, 400, 500, 600 in a compact stacked arrangement. When stacking, the reel component 100 is placed with one of the pairs of accommodation holes 136, 138; 137, 139 being in alignment with the locking arms 132, 133 of the reel component 300 onto which the reel component 100 is being stacked. Simultaneously, the ribs of the reel component 100 are aligned with the engaging slots of the reel component 300. With further stacked reel components, the pairs of accommodation apertures 136, 138; 137, 139 are alternately aligned with the locking arms 132, 133 of the adjacent stacked reel component, thereby resulting in a staggered arrangement with the accommodation apertures 136, 137, 138, 139 of every other of the stacked reel components being aligned.

Figure 8:
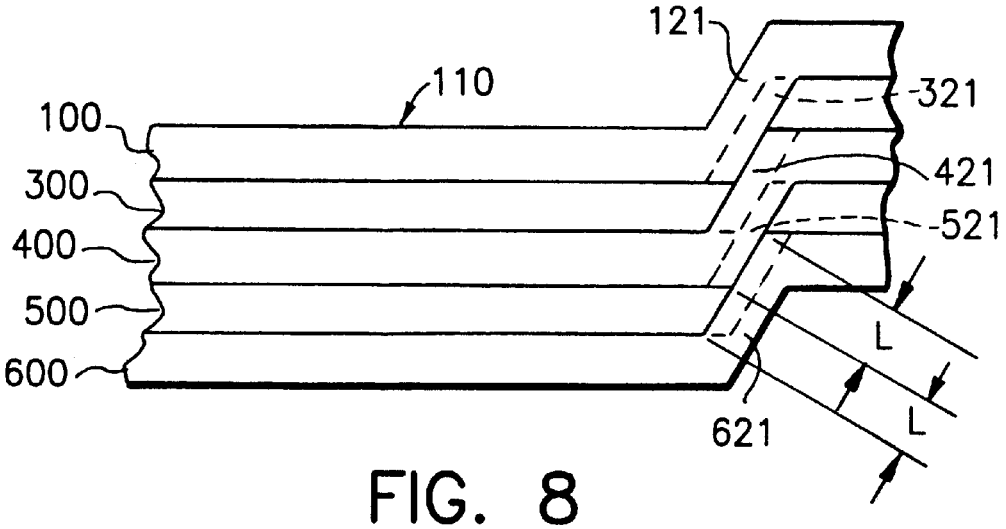
FIG. 8 is a cut-away view of the ribs of five new and improved reel components of the subject invention in stacked engagement.

In a stacked arrangement, the ribs 121, 122 of the reel component 100 register with the through slots of the neighboring reel component 300 and avoid contact with the ribs of the neighboring reel component 300 altogether. Referring to FIG. 8, the rib 121 of the reel component 100 comes into contact with a rib 421 of the reel component 400, whereas, the rib 321 of the reel component 300 comes into contact with the rib 521 of the reel component 500. To ensure even stacking, only half of each rib should be in contact with the respective abutting rib. As shown in FIG. 8, half of the rib 421, designated by dimension "L", is in contact with half of the rib 621, also designated as "L". To achieve this result, the thickness of the ribs, as well as the angle at which the ribs are disposed, must be adjusted along with the thickness of the side wall 110. As a result of this stacking method, neighboring stacked reels, such as 100 and 300, do not have any interference between the ribs 121, 321 thereby allowing compact stacking.

Figure 11:
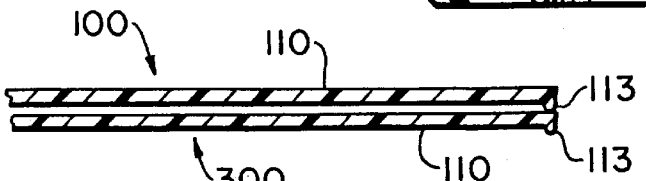
FIG. 11 is a cut-away view of the beads of two new and improved reel components in stacked engagement.

As shown by example in FIG. 9, when stacked, the locking arm 132 of the reel component 300 is enveloped by the accommodation aperture 136 of the reel component 100. The reel components 100, 300 are nested so that the tapered portions 126 of the bosses 125 are in contact, and the frustum 127 of the reel component 100 rests on the frustum 127 of the reel component 300. To provide additional support for the stacked reel components, a bead 113, shown in FIG. 11, may be provided to portions of or to the entire circumference of the side wall 110. The bead 113 extends in an opposite direction from the hub 120 and is disposed on the surface of the side wall 110 opposite the hub 120. By providing contact between the side walls 110 of neighboring stacked reels 100, 300, the bead 113 ensures contact between outer portions of stacked reel components and provides support for the entire stack of the reel components. In the preferred embodiment, at least the bead 113, the tapered portions 126 and the frustum 127 of the reel component 100 will be in contact with adjacent stacked reel components, whereas the ribs 121, 122 will be in contact with the ribs of non-adjacent stacked reel components.

Figure 10:
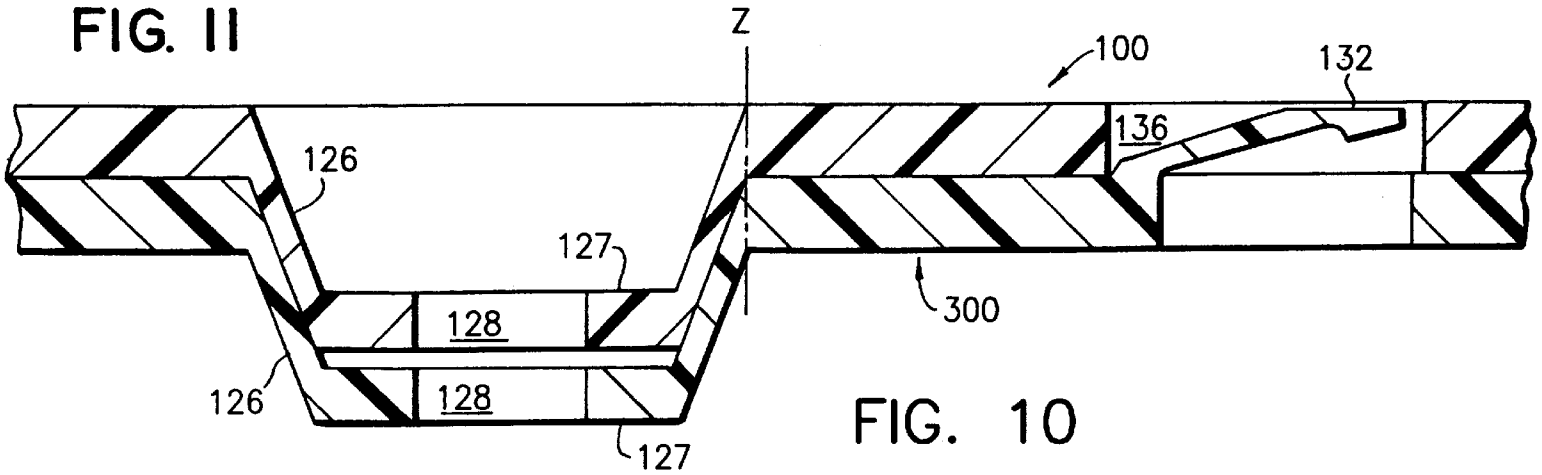
FIG. 10 is a cut-away view of an alternative embodiment of two new and improved reel components in stacked engagement taken along a line along the longitudinal axis of a locking arm and passing through the center of the reel components.

As shown in FIG. 10, in an alternative embodiment, the locking arms 132, 133 can be formed to have a height less than or equal to the thickness of the attaching wall 130. With such an arrangement, the corner formed at the inner union of the tapered portion 126 and the attaching wall 130 must define an opening with a diameter at least equal to the diameter defined by the outer union of the tapered portion 126 and the attaching wall 130, as indicated by reference line "z". Additionally, although not shown, the opening defined by the tapered portion 126 may define a diameter greater than the outer diameter formed at the union of the tapered portion 126 and the attaching wall 130. The size of the opening 126 may be enlarged by reducing the thickness of the wall forming the tapered portion 126 and/or adjusting the taper of the tapered portion 126. In addition, the thickness of the frustum 127 may be reduced to ensure a compact stacking arrangement.

While the invention has been described with respect to a preferred embodiment, it is apparent that various changes may be made without departing from the spirit and scope of the invention as defined by the appended claims.

What is claimed is:

1. A stacking reel component for forming a reel used for storing carrier tape and items disposed on the tape, said stacking reel component comprising:

a planar side wall, and a hub extending from said side wall, said hub including a center, said hub including a planar attaching wall spaced from said side wall, and means for allowing the stacking reel component to be stacked in a compact stacked arrangement, said means including a plurality of ribs extending between said attaching wall and said side wall, each said rib having an inner surface generally facing the center and an outer surface generally facing away from the center, said ribs being spaced about said attaching wall such that each corresponding pair of adjacent said ribs form a through slot therebetween, each said through slot defining an opening in said hub extending between said inner and outer surfaces of said corresponding pair of adjacent said ribs, each said rib being formed to define a first width, each said through slot being formed to define a second width, said second width being greater than said first width.

2. A stacking reel component as in claim 1, wherein said ribs are arranged to form a circle.

3. A stacking reel component as in claim 1, wherein said ribs are angularly disposed relative to said side wall.

4. A reel for storing carrier tape and items disposed on the tape, said reel comprising:

a first reel component and a second reel component, each said reel component having:

a planar side wall;

a hub, said hub including a planar attaching wall spaced from said side wall, said hub including a center, said hub further comprising a plurality of ribs extending between said side wall and said attaching wall, each said rib having an inner surface generally facing the center and an outer surface generally facing away from the center, said ribs being spaced about said attaching wall such that each corresponding pair of adjacent said ribs form a through slot therebetween, each said through slot defining an opening in said hub extending between said inner and outer surfaces of said corresponding pair of adjacent said ribs, said attaching wall defining a planar attaching surface, said attaching wall being substantially parallel with respect to said side wall, said attaching wall including:

two elongated locking arms, each said locking arm having a base connected to said attaching wall and extending from said attaching surface away from said side wall;

two elongated receiving arms, each said receiving arm having a base connected to said attaching wall and a top surface coplanar with said attaching surface; and receiving apertures, each said receiving aperture extending from a respective one of said receiving arms, wherein one of said locking arms, one of said receiving arms, and one of said receiving apertures extend along a first linear axis, wherein the other of said locking arms, the other of said receiving arms, and the other of said receiving apertures extend along a second linear axis, said first linear axis being parallel to said second linear axis;

each of said arms being formed with a depending detent having an engaging surface which defines an acute angle with respect to said arm and generally faces the base of said arm;

wherein said attaching surface of said first reel component is in engagement with said attaching surface of said second reel component, said locking arms of said first reel component extending through said receiving apertures of said second reel component, said locking arms of said second reel component extending through said receiving apertures of said first reel component, with said engaging surfaces of said locking arms being in engagement with said engaging surfaces of said receiving arms.

5. A reel as in claim 4, wherein said spacing of said attaching wall from said side wall of said first reel component is substantially equal to said spacing of said attaching wall from said side wall of said second reel component.

6. A reel as in claim 4, wherein said spacing of said attaching wall from said side wall of said first reel component is greater than said spacing of said attaching wall from said side wall of said second reel component.

7. A reel as in claim 4, wherein each said acute angle is in a range of 10 to 25 degrees.

8. A reel as in claim 7, wherein each said acute angle is 15 degrees.

9. A reel as in claim 4, wherein each said reel component further comprises at least four accommodation apertures disposed in said attaching wall with each said accommodation aperture and each said locking arm being spaced from said center a first distance.

10. A reel as in claim 4, wherein each said rib being formed to define a first width, each said through slot being formed to define a second width, said second width being greater than said first width.

11. A combination of reel components comprising:

a first reel component and a pair of second reel components, each said reel component being formed with:

a substantially planar side wall; and a hub extending from said side wall, said hub including a planar attaching wall spaced from said side wall, and a plurality of ribs extending between said attaching wall and said side wall, said ribs being spaced about said attaching wall such that each corresponding pair of adjacent said ribs form a through slot therebetween;

wherein said first and second reel components are disposed in a stacked relationship with said side walls being substantially parallel to each other and with said first reel component being interposed between said second reel components, said ribs of both said second reel components registering with and extending into said through slots of said first reel component and abutting one another.

12. A combination of reel components as in claim 11, wherein said attaching wall of each said reel component is formed with a plurality of projections extending from said attaching wall in a direction away from said side wall and a plurality of apertures, and wherein said projections of said first reel component are disposed to extend into said apertures defined in one of said second reel components.

13. A combination of reel components as in claim 12, wherein each said aperture of one of said second reel components is axially aligned with a respective one of said apertures of the other of said second reel components.

14. A combination of reel components as in claim 11, wherein each said rib is formed with a predetermined length and opposing outer surfaces, which substantially extend said predetermined length, wherein said pair of second reel components includes an upper second reel component and a lower second reel component, and wherein each said rib of said upper second reel component has one half the length of one said outer surface being in abutting contact with one half the length of one said outer surface of a respective one of said ribs of said lower second reel component.

15. A combination of red components as in claim 11, wherein each said reel component further comprises each said rib being formed to define a first width, each said through slot being formed to define a second width, said second width being greater than said first width.

16. A combination of reel components as in claim 11, wherein said hub of said first reel component is in at least partial abutting contact with said hub of at least one said second reel component.

17. A combination of reel components as in claim 11, wherein said side wall of each said reel component is formed to define a periphery spaced from said hub and a bead on at least portions of said side wall adjacent said periphery.

18. A combination of reel components comprising:

first and second reel components, each said reel component being formed with:

a substantially planar side wall; and a hub extending from said side wall, said hub including a planar attaching wall spaced from said side wall, said attaching wall having at least one protrusion and at least one accommodation aperture;

wherein said first and second reel components are disposed in a stacked relationship with said side walls being substantially parallel to one another and said hub of said first reel component being at least partially inserted into said hub of said second reel component, said protrusion of said first reel component extending into said accommodation aperture of said second reel component.

19. A combination of reel components as in claim 18, wherein said second reel component further comprises, said hub defining a center, said protrusion being located a first distance from said center, and said accommodation aperture also being located said first distance from said center.

20. A combination of reel components as in claim 19, wherein said second reel component further comprises, said attaching wall having a plurality of said protrusions and plurality of said accommodation apertures, each said protrusion being located said first distance from said center, each said accommodation aperture also being located said first distance from said center, and wherein said plurality of said accommodation apertures being twice as great in quantity relative to said plurality of said protrusions.

21. A combination of reel components as in claim 20, wherein said second reel component further comprises, said plurality of said protrusions comprises first and second said protrusions, said first and second said protrusions being disposed to define a second distance therebetween, said plurality of said accommodation apertures comprises first, second, third and fourth said accommodation apertures, said first and second said accommodation apertures being disposed to define said second distance therebetween, and said third and fourth said accommodation apertures being disposed to define said second distance therebetween.

22. A combination of reel components as in claim 18, wherein, said hub of each said reel component defines a center, and further comprises a plurality of ribs extending between said side wall and said attaching wall, each said rib having an inner surface generally facing the center and an outer surface generally facing away from the center, said ribs being spaced about said attaching wall such that each corresponding pair of adjacent said ribs form a through slot therebetween, each said through slot defining an opening in said hub extending between said inner and outer surfaces of said corresponding pair of adjacent said ribs.

23. A combination of reel components as in claim 22, wherein, each said rib being formed to define a first width, each said through slot being formed to define a second width, said second width being greater than said first width.

24. A combination of reel components as in claim 18, wherein, for each said reel component, said accommodation aperture is spaced away from said protrusion.

25. A combination of reel components as in claim 18, wherein each said reel component further comprises, said attaching wall defining a plane, and said protrusion having opposing first and second ends, said first end being connected to said attaching wall, said second end being spaced from said first end a distance, and said accommodation aperture having an inner surface formed to define a diameter greater than said distance.

26. A combination of reel components as in claim 18, wherein said side wall of said second reel component defines a periphery and a bead is formed along at least a portion of the periphery of said side wall of said second reel component.

* * * * *